US008197159B2

(12) United States Patent
Ridgway

(10) Patent No.: US 8,197,159 B2
(45) Date of Patent: Jun. 12, 2012

(54) WIRE FACING UNIT FOR RETAINING WALLS WITH STRUT ATTACHMENT LOCATOR

(75) Inventor: Jon Robert Ridgway, Marietta, GA (US)

(73) Assignee: Tensar Corporation, Atlanta, GA (US)

( * ) Notice: Subject to any disclaimer, the term of this patent is extended or adjusted under 35 U.S.C. 154(b) by 117 days.

(21) Appl. No.: 12/461,923

(22) Filed: Aug. 27, 2009

(65) Prior Publication Data

US 2011/0052333 A1 Mar. 3, 2011

(51) Int. Cl.
*E02D 17/00* (2006.01)

(52) U.S. Cl. ..... 405/284; 405/262; 405/302.7

(58) Field of Classification Search ..... 405/16, 405/17, 19, 262, 272, 284, 302.4, 302.6, 405/302.7

See application file for complete search history.

(56) References Cited

U.S. PATENT DOCUMENTS

| | | | | |
|---|---|---|---|---|
| 3,316,721 | A * | 5/1967 | Heilig | 405/262 |
| 5,722,799 | A | 3/1998 | Hilfiker | |
| 5,733,072 | A * | 3/1998 | Hilfiker et al. | 405/284 |
| 5,800,095 | A * | 9/1998 | Egan | 405/262 |
| 6,345,934 | B1 * | 2/2002 | Jailloux et al. | 405/262 |
| 6,595,726 | B1 | 7/2003 | Egan et al. | |
| 6,764,252 | B2 * | 7/2004 | Banting | 405/262 |
| 7,281,882 | B2 * | 10/2007 | Hilfiker et al. | 405/262 |
| 2005/0286981 | A1 * | 12/2005 | Robertson et al. | 405/284 |
| 2006/0204343 | A1 * | 9/2006 | Kallen | 405/284 |
| 2006/0239783 | A1 * | 10/2006 | Kallen | 405/284 |

* cited by examiner

*Primary Examiner* — David Bagnell
*Assistant Examiner* — Benjamin Fiorello
(74) *Attorney, Agent, or Firm* — Jacobson Holman PLLC

(57) ABSTRACT

A wire strut indicator facing unit for a retaining wall, such as a temporary retaining wall, having an upstanding face section and a rearwardly extending floor section, wherein the floor section is formed from pairs of parallel wire elements and transverse cross-wire elements, and otherwise substantially free of wire elements between the wire element pairs. The pairs of parallel wires define the attachment location for a wire strut that extends between the face section and floor section of the facing unit.

18 Claims, 5 Drawing Sheets

WIRE FACING UNIT FOR RETAINING WALLS WITH STRUT ATTACHMENT LOCATOR

BACKGROUND OF THE INVENTION

1. Field of the Invention

This invention relates to a wire facing unit for retaining walls and reinforced soil slopes that require placement of supporting struts at predetermined spacings along the width of the facing unit. The wire facing unit includes a built-in structural locator arrangement to provide a visual indication or reference for the installer to place the supporting struts at the correct locations.

2. Description of the Related Art

The formation of retaining walls such as Mechanically Stabilized Earth Walls (MSEW) and Reinforced Soil Slopes (RSS) and the use of reinforcing materials, such as geogrids for such structures is well known. The success of these structures relies not only on the reinforcing materials, but also on the manner in which the MSEW and RSS structures are installed. One of the main areas for poor construction technique is the wall or slope face. Under current design guidelines of the American Association of State Highway and Transportation Officials ("AASHTO"), MSEW and RSS structures may be constructed with a so-called wrap system, whereby a geogrid, typically a biaxial geogrid, is wrapped within a wire facing unit from the bottom surface above a floor section, then upward parallel to the face section, and then over the top fill surface to provide soil retention and, in the case of a RSS structures, possibly long-term face stability. This wrap technique is a very economical solution and has been utilized by many departments of transportation over the past two decades. However, face stability, compaction and geosynthetic placement is very difficult in wall and steep slope applications without the use of an effective face forming system employing wire facing units.

Known wire facing units typically are in the form of welded wire structures defining a rectangular-shaped face section and a rectangular-shaped floor section positioned angularly with respect to each other, preferably at a right angle. Support struts are selectively positioned along the width of the wire facing unit to provide strength and support. The width of such facing units are substantially greater than the height and depth of the facing unit. For example, the width may be ten feet and the height of the face section and depth of the floor section may be substantially smaller, e.g., 18 inches. Such wire facing units may be used with reinforcements, such as geogrid reinforcements, both uniaxial geogrids and biaxial geogrids. Fill material such as soil is located within the wall in the space defined by the face section and floor section. As such, the facing unit is subjected to high stresses and the welded wire facing units used in such temporary retaining walls typically require support struts positioned at predetermined, relatively precise locations to support the face section with respect to the floor section so that the loads that are applied to the walls do not cause sagging or bending of the facing unit. Current AASHTO specifications allows for a maximum outward bulge of the face section of 2 inches between strut connections. It has been found through experience in wall and slope installation that the installation of the support struts at 24 inches center to center maximum provides for the wall or slope face performing as intended and meeting the current AASHTO guidelines for face section alignment.

The installation of the support struts is performed on site. The installers first position a wire facing unit at the location where the wall is to be constructed and then install the wire struts at locations along the width of the wire facing unit. The installer may be told or instructed to install the wire struts at predetermined locations, for example every two feet, but errors in locating the wire struts can occur such that the wire struts may be located further apart from the required spacing, thus resulting in a weakened temporary retaining wall structure.

The known wire facing unit (sometimes referred to as a basket) while simple, does not provide the installer an easy way to make sure that the support struts are installed in the proper location. It is very common for the installer to space the struts beyond the predetermined maximum spacing requirement (i.e., beyond the prescribed two foot spacing) which can lead to excessive bulging beyond the current AASHTO allowance.

SUMMARY OF THE INVENTION

An initial object of the present invention is to provide a wire facing unit for a retaining wall system, such as a temporary retaining wall system, in combination with wire struts which overcomes the foregoing and other such disadvantages in prior art systems.

A further object of this invention is the provision of a wire facing unit formed from welded wire having a built-in structural locator or indicator arrangement that enables the installer to precisely locate the wire struts to be installed between the face section and floor section of the wire facing unit. Specifically, it is an object of the present invention to provide a wire facing unit wherein the floor section includes pairs of parallel wires that define the location where the wire facing strut is to be connected to the floor section.

A still further object of this invention is to provide an assembly of elements to easily and inexpensively form a retaining wall section with a precise location of wire connecting struts requiring the use of no extraneous materials or tools and enabling installation quickly, easily and accurately.

Other and further objects of this invention will be readily understood by those with ordinary skill in the art with particular reference to the following detailed description of the preferred embodiments in combination with the accompanying drawings.

BRIEF DESCRIPTION OF THE DRAWINGS

Like reference characters refer to like parts throughout the several views of the drawings.

DETAILED DESCRIPTION OF THE PREFERRED EMBODIMENTS

Figure 1:
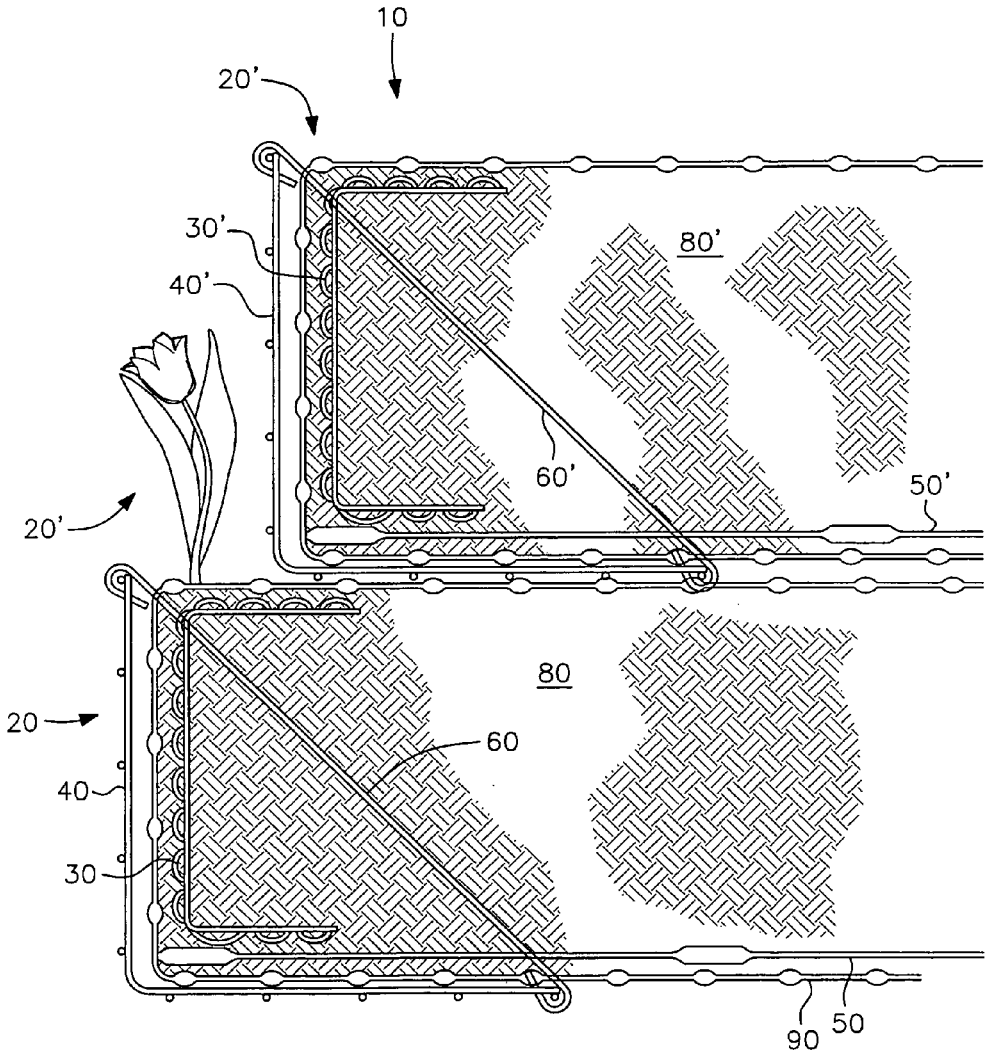
FIG. 1 PRIOR ART
FIG. 1 is a schematic side elevational view of a portion of a prior art reinforced geogrid retaining wall having superimposed wire facing units with the front face of the superior facing unit offset rearwardly from the front face of the facing unit therebelow to provide access to the fill for plantings.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

Figure 2A:
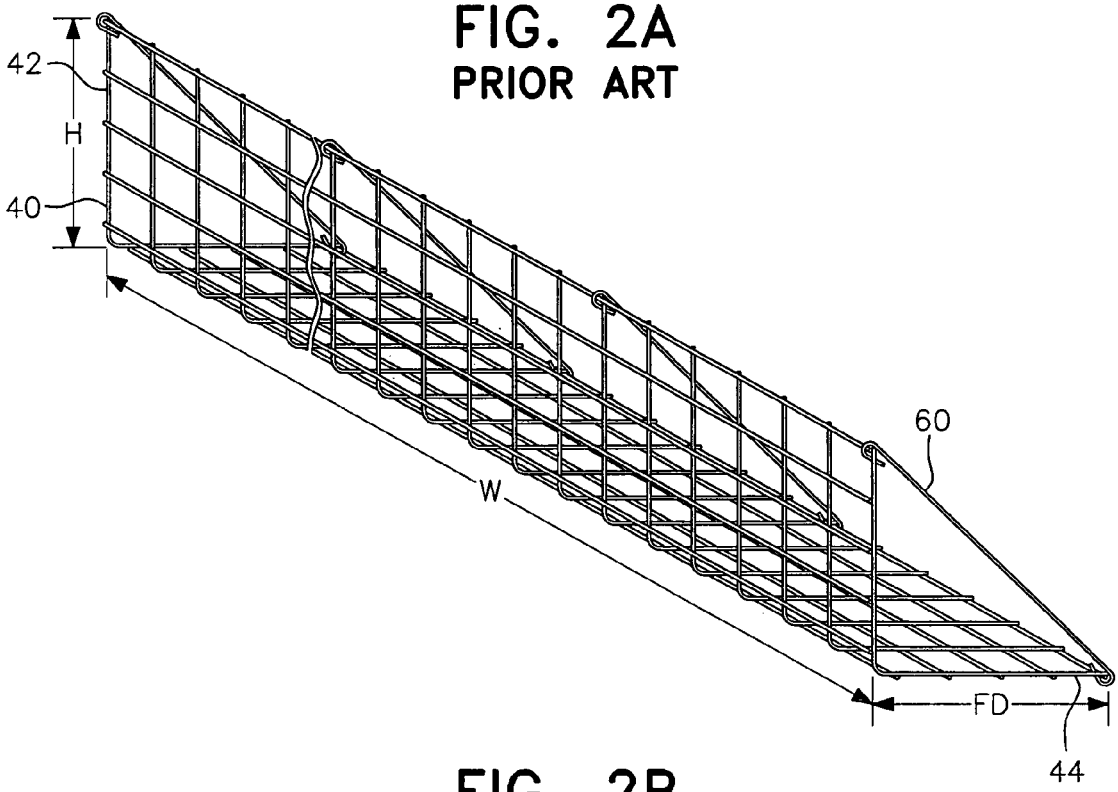
FIG. 2A PRIOR ART
FIGS. 2A and 2B depict a prior art wire facing unit and support strut to which the present invention is an improvement.

A retaining wall constructed using a system of the prior art is shown in FIGS. 1 and 2, and indicated generally by the reference numeral 10 in FIG. 1. In this Figure, two tiers or layers 20, 20' of geogrid-reinforced wall sections are depicted. Of course, although two tiers 20, 20' are illustrated in FIG. 1, retaining walls can be built of only a single tier or many more than two tiers, depending upon the height of the wall and the dimensions of the elements forming the wall. Not only can the height be variable, but the width of the wall can likewise be variable by providing wire facing units of different widths (width w of a facing unit is indicated in FIG. 2A) or by associating a multiplicity of laterally juxtaposed assemblies of wire facing units as is known in the art. Generally, when adjacent wire facing units are disposed in a side-by-side relationship, there is an overlap between the adjacent ends of the wire facing unit.

Each of the layers 20, 20' of the prior art retaining wall 10 is formed from an assembly of elements including a wire facing unit 40, one or more sections of geogrid, including uniaxial geogrid 50 and/or biaxial geogrid 90, a connector strut 60, a body of fill material 80, and a reinforcement mat 30, typically formed of geotextile fabric.

Figure 2B:
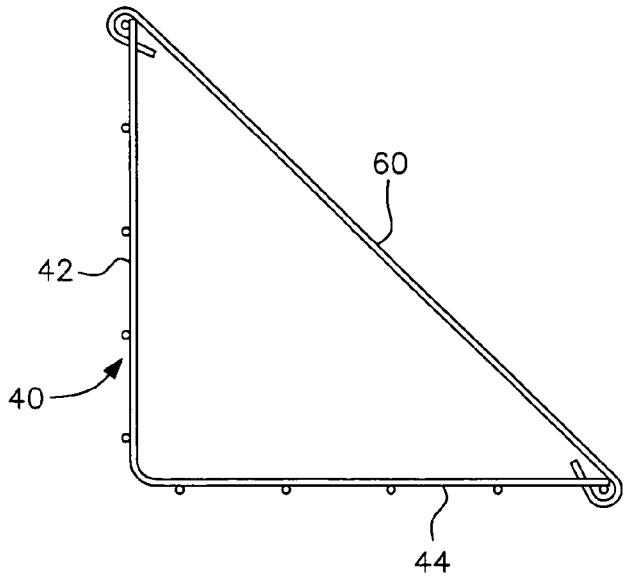
FIG. 2B PRIOR ART

The prior art wire facing unit 40 and support strut 60 is depicted in greater detail in FIGS. 2A and 2B. There, the wire facing unit includes a face section 42 and a floor section 44 formed from welded wire defined by transverse and parallel wires of 3.5 gauge, approximately ¼ inch in diameter, and orthogonally disposed with respect to each other at four inch square intervals. The wire is typically fabricated with black wire and the width of the facing unit is preferably ten feet with the height and floor depth each approximately 18 inches. Of course, the dimensions can vary to be longer, wider, or with varying depths depending upon the needs. The support strut 60 is similarly of black wire with approximately a ¼ inch diameter and includes a length that forms a hypotenuse of a right triangle as is best shown in FIG. 2B. As discussed above, the support strut 60 is attached on-site by the installer and is intended to be spaced apart from adjacent struts at approximately two foot spacings, or less, so as to provide sufficient strength and support. Of course, the required spacing of the struts can vary depending on the strength requirements of the facing unit and the particular dimensions and strengths of the wire elements that are used to form the facing unit and struts. For the dimensions described above, the strut spacing should not exceed two feet.

The prior art retaining wall and components as shown in FIGS. 1 and 2 include geogrid reinforcement. Only a single geogrid of either biaxial or uniaxial shape may be utilized or, as shown, both biaxial 90 and uniaxial 50 geogrids may be employed. The biaxial geogrid 90 is shown wrapped about the soil.

Figure 3:
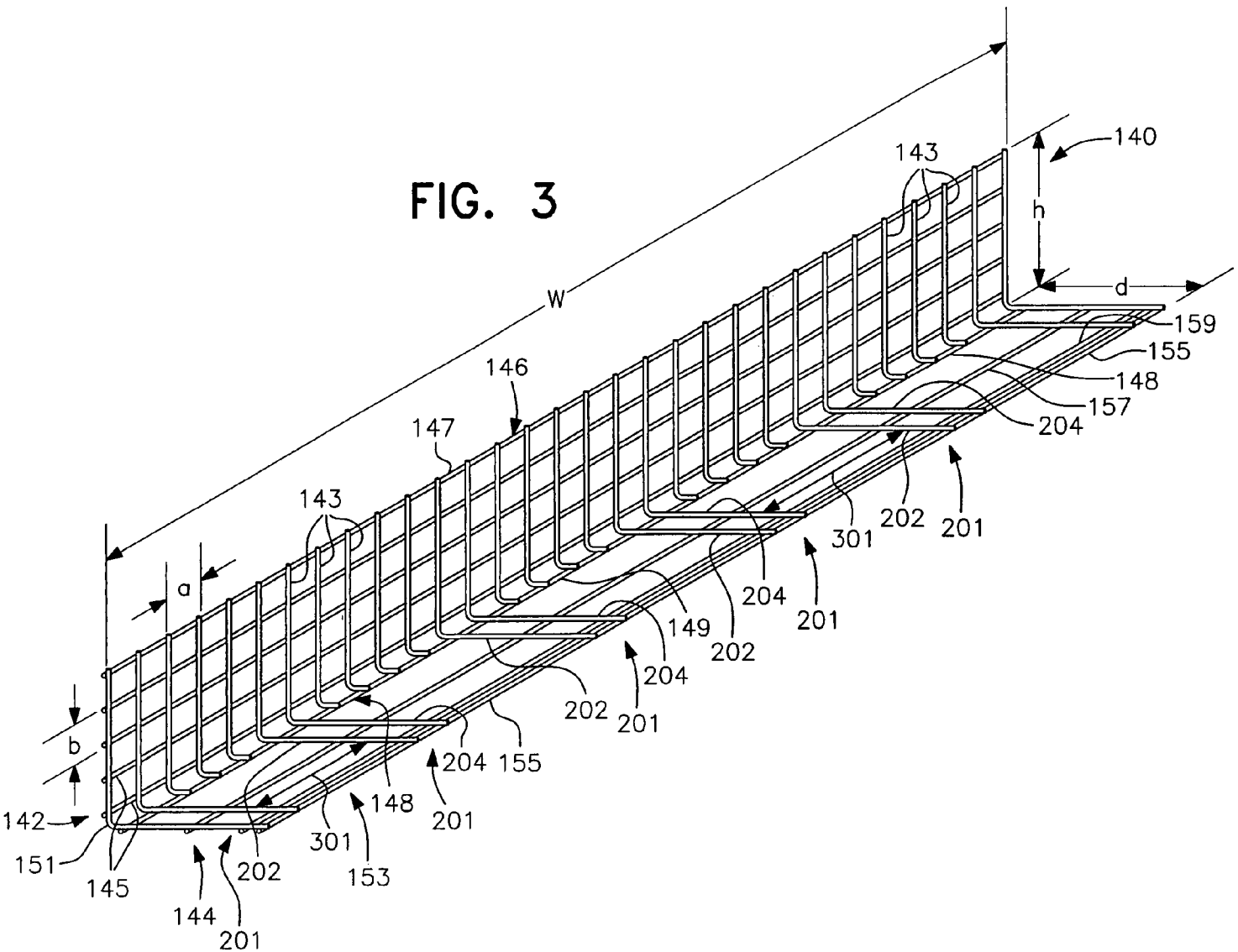
FIG. 3 is an isometric view of the wire facing unit of the present invention.
Figure 4A:
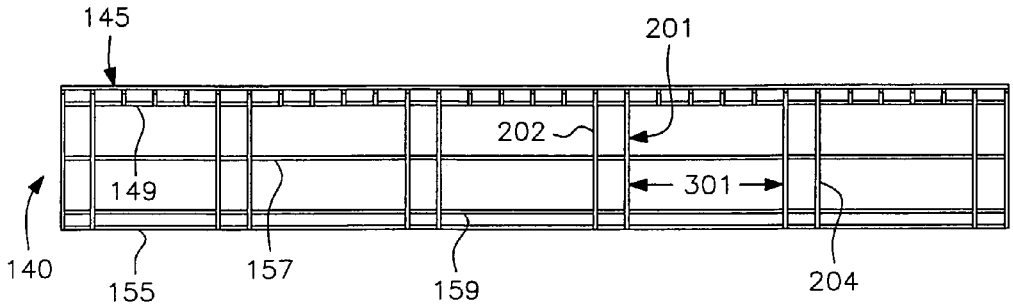
FIGS. 4A and 4B are plan view and section view respectively of the wire facing unit of the present invention with a support strut shown attached in FIG. 4B.
Figure 4B:
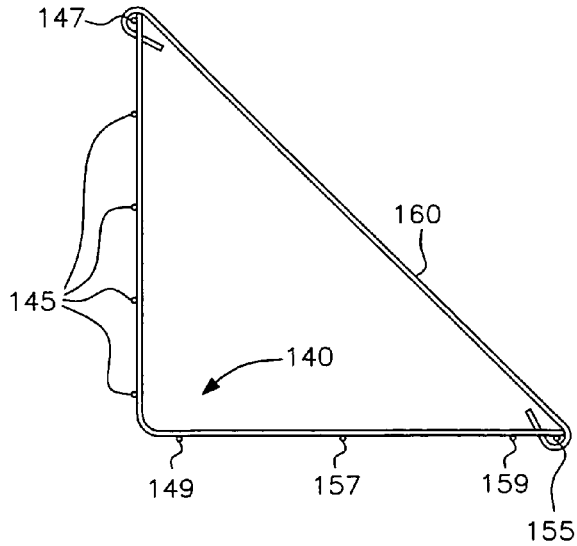
Figure 5:
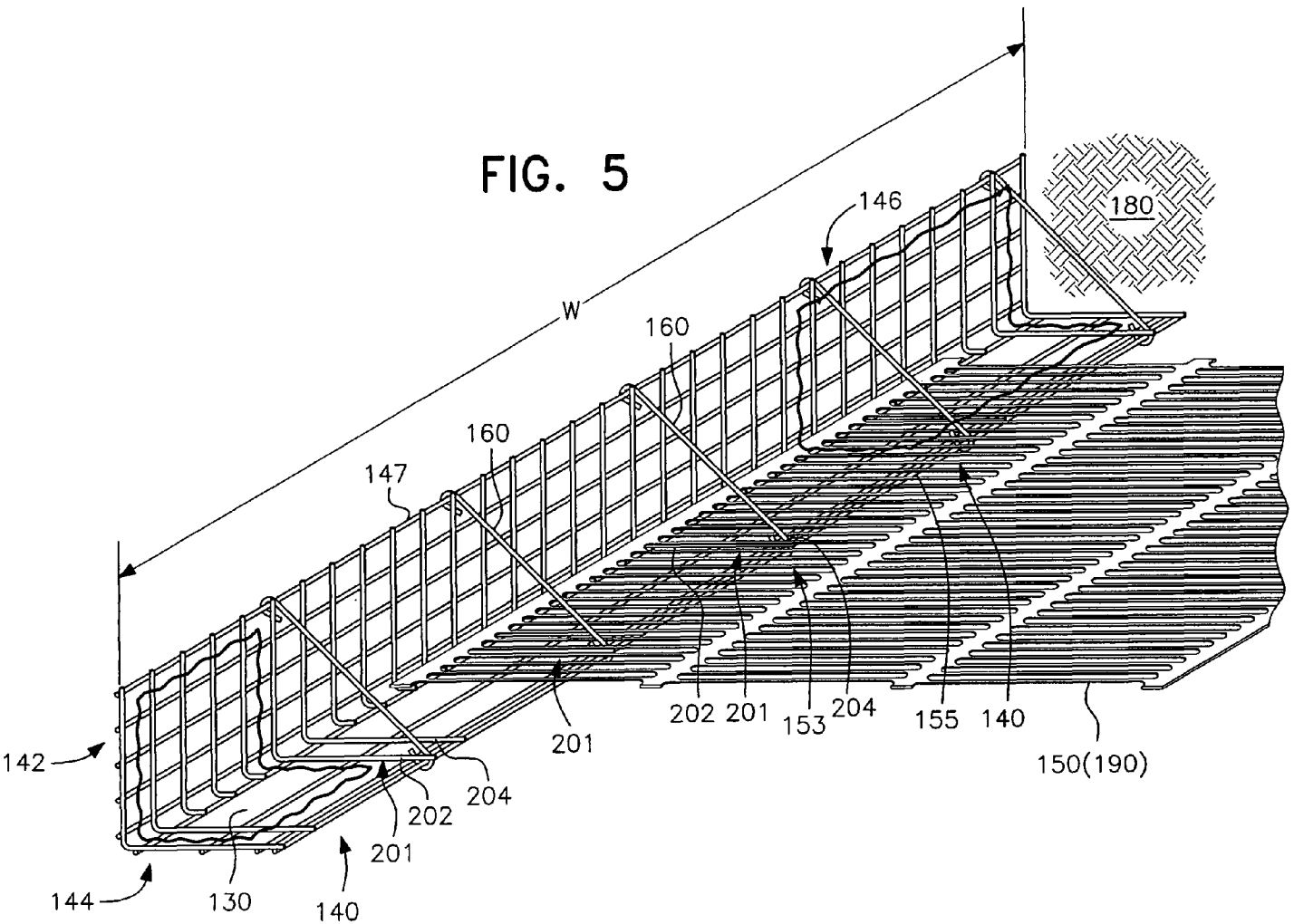
FIG. 5 is a perspective view of the wire facing unit of FIG. 3 with support struts and geogrid reinforcement and geotextile facing fabric.

The wire facing unit of the present invention is shown in FIGS. 3-5 and generally designated by reference numeral 140. It includes a strut indicator arrangement as will be described. As shown in FIG. 3, the wire facing unit 140 includes a face section 142 and floor section 144 of generally rectangular shape having a face section height h, a floor section depth d, and a width w. The overall dimensions are similar to those known in the prior art, i.e., the width may be ten feet, the height and the floor depth may be 18 inches. These dimensions are variable depending upon the specific material needs or requirements, as discussed above with respect to the conventional systems, and the present invention is not limited to any specific dimensions.

The rectangular face section 142 includes a free top edge 146 and a bottom edge 148 formed from plural parallel wire elements 143 that extend from the top edge 146 to the bottom edge 148. The parallel wire elements 143 are interconnected by a plurality of transverse parallel cross-wire elements 145, including a transverse cross-wire element 147 at the free top edge 146 and a transverse cross-wire element 149 adjacent the bottom edge 148. The face section 142 is depicted as a grid of intersecting welded wires having similar dimensions to the face section shown in the prior art system of FIGS. 1 and 2. That is, the transverse cross-wires 145, 147, 149 and parallel vertically oriented wires 143 are preferably positioned equidistant from each other to form a plurality of square openings. See FIG. 3 with "a"=b." The exact construction of the face section is not particularly critical and the number of transverse cross-wire elements 145, for example, could be lessened as could the number of vertically oriented parallel wires 143, so as to form non-square rectangular openings.

The face section 142 is substantially planar and includes a curve or bend 151 adjacent the bottom edge 148. The bottom edge 148 is defined herein as the edge after the bend or turn 151 in a rearward direction.

The floor section 144 extends from the bottom edge 148 of the face section rearwardly to a floor section free rear edge 153. The floor section rear edge 153 includes a transverse cross-wire element 155. The floor section 144 includes adjacent pairs 201 of parallel wire elements 202, 204 that extend between the face section bottom edge 148 and the floor section rear edge 153 and are basically continuations of parallel vertically oriented wire elements 143 on the face section. Each pair 201 is spaced from adjacent pairs at a location where the wire struts 160 are to be installed.

The floor section further includes transverse cross-wire elements 157, 159 in addition to the transverse cross-wire element 155 at the rear edge 153. As is depicted in FIGS. 3 and 4B, one transverse cross-wire element 149 is positioned near the leading edge of the floor section, adjacent bend 151, and two transverse cross-wire elements 157, 159 are intermediate the cross-wire elements 149 and 155. One intermediate cross-wire element 157 is located substantially half-way between the transverse cross-wire element 149 and the transverse cross-wire element 155 at the floor section rear edge 153. The other intermediate transverse cross-wire element 159 is shown adjacent the rear edge transverse cross-wire element 155. It should be appreciated that additional transverse cross-wire elements could be utilized and, indeed, the transverse cross-wire elements could be located spaced apart from each other substantially similar to the spacing of the transverse cross-wire elements in the face section.

Each parallel wire element pair 201 is spaced from adjacent wire element pairs by a predetermined spacing 301. The spacing 301 is predetermined to be at a location necessary to provide the needed strength and support. As discussed above, for the particular size of the facing unit and diameter of the wires and wire material, a two-foot spacing is appropriate.

The spacing 301 between adjacent pairs 201 is free of any wire elements that extend between the face section bottom edge 148 and floor section rear edge 153. Specifically, no parallel wires lie between the pairs 201 of parallel wire elements 202, 204. The space 301 is substantially open, except for the transverse cross-wire elements 157, 159. With such an arrangement, it will be clear to an installer as to where a wire strut 160 is to be attached to the floor section 144 (i.e., between the parallel wires 202, 204 of the parallel wire pair 201) and accordingly to the free top edge cross-wire element 147 of the face section 142. The installation location of the strut 160 is depicted in FIGS. 3, 4A, 4B and 5.

The spacing 301 between adjacent pairs 201 is "substantially free" of any wire elements that extend between the face section bottom edge 148 and floor section rear edge 153. By "substantially free" is not only meant that the entire space 301 between the pairs 201 is free of any wire elements that extend in a front to rear direction from the bottom edge 148 to the rear edge 153 but also means that if there are a few such wire elements, the wire elements are located so as not to conflict with or confuse an installer in knowing where to locate the support strut. For example, it is possible that a single wire may be located mid-way between the pairs 201 in the space 301 to extend from the transverse cross-wire element 149 at the face section bottom edge 148 to the floor section rear edge 153. However, the inclusion of such a wire would not detract from the locator structure and would not confuse the installer as to the strut attachment location. Even with the inclusion of this additional wire, the spacing 301 would still be "substantially free of any wire elements that extend between the bottom edge and rear edge."

FIG. 5 depicts a retaining wall system that includes the wire strut indicator facing unit 140 and strut assembly 160 of the present invention. A wire facing unit 140 of the present invention is depicted along with several struts 160 disposed between the two parallel wires 202, 204 that form the parallel wire pair 201. As is further shown in FIG. 5, a uniaxial geogrid 150 (which could instead include a biaxial geogrid 190 or could include the two geogrids together in a manner similar to the prior art arrangement as shown in FIG. 1) is included. In the FIG. 5 embodiment, the geogrid(s) 150, 190 overlie much of the floor section 144 thus requiring the struts 160 to extend through openings within the geogrid 150, 190. Alternatively, the geogrid 150 may be placed on the ground with the floor section 144 simply lying on top, thus having no connection between the geogrid reinforcement and the wire facing unit. Also depicted in FIG. 5 is a cutaway of the erosion mat or blanket 130 of conventional construction, such as a geotextile, placed inside the face section 142 of the wire facing unit 140. Fill material 180, such as aggregate, soil or the like, is filled behind the rear face of the face section 142 on top of the upper face of the floor section 144 in a manner typically shown in FIG. 1.

Thus, by the use of a structural arrangement where the parallel wire pairs 201 are spaced from each other at the distance required to maintain the strength of the wire facing unit, the installer, in the field, will be easily focused or alerted to the location of where the wire struts are to be placed. This ensures stability and structural rigidity for the facing unit as the retaining wall is built. No longer will the installer have to guess or physically measure the location of wire strut placement, thus ensuring a stable, secure and strong retaining wall.

The foregoing descriptions and drawings should be considered as illustrative only of the principles of the invention. As noted, the invention may be configured in a variety of shapes and sizes and is not limited by the dimensions of the preferred embodiment. Numerous applications of the present invention will readily occur to those skilled in the art. Therefore, it is not desired to limit the invention to the preferred embodiments or the exact construction and operation shown and described. Rather, all suitable modifications and equivalents may be resorted to, falling within the scope of the invention.

What is claimed is:

1. A wire strut indicator facing unit for a retaining wall comprising a rectangular face section having a free top edge and a bottom edge and formed from plural parallel wire elements extending from said top edge to said bottom edge interconnected by a plurality of transverse cross-wire elements including a transverse cross-wire element at said free top edge and a transverse cross-wire element adjacent said bottom edge, a rectangular floor section extending from said face section bottom edge and having a free rear edge, said floor section formed from a plurality of transverse cross-wire elements including a transverse cross-wire element at said rear edge, said floor section further including a plurality of pairs of parallel wire elements extending from said face section bottom edge to said floor section rear edge, each parallel wire element pair defining an attachment location there between for a wire strut extendable between said face section and floor section, a space between adjacent pairs of parallel wire elements being significantly greater than a space between the wire elements of each parallel wire element pair, and the space between said adjacent pairs of parallel wire elements being at predetermined intervals at a sufficient distance apart so as to provide a precise wire strut attachment location for a desired strength and support of the face section.

2. The wire strut indicator facing unit as claimed in claim 1, wherein said face section is planar with a curved portion adjacent said bottom edge, said bottom edge offset from said planar face section.

3. The wire strut indicator facing unit as claimed in claim 1, wherein said face section plural parallel wire elements and said face section plural transverse cross-wire elements are equidistant from each other.

4. The wire strut indicator facing unit as claimed in claim 1, wherein said floor section is planar from said face section bottom edge to said floor section rear edge.

5. The wire strut indicator facing unit as claimed in claim 4, wherein said plurality of floor section transverse cross-wire elements further includes a first intermediate transverse cross-wire element located approximately halfway between the face section bottom edge and floor section rear edge and a second intermediate cross-wire element located adjacent said transverse cross-wire element at said rear edge.

6. The wire strut indicator facing unit as claimed in claim 5, wherein said first and second intermediate and rear edge transverse cross-wire elements are the only transverse cross-wire elements of said floor section.

7. The wire strut indicator facing unit as claimed in claim 1, wherein each parallel wire element of said floor section is a continuation of a wire element of said face section.

8. A wire strut indicator facing unit and strut assembly for a retaining wall comprising, (a) at least one wire strut indicator facing unit including a face section and a floor section extending angularly from said face section, said face section and said floor section formed from plural parallel wire elements bent angularly near a midpoint, said face section having a transverse cross-wire element at its top edge and said floor section having a transverse cross-wire element at its rear edge, said floor section parallel wire elements defining a plurality of pairs of parallel wire elements, each parallel wire element pair defining an attachment location for a wire strut extendable between said face section and floor section, a space between adjacent pairs of parallel wire elements being significantly greater than a space between the wire elements of each parallel wire element pair, and the space between said adjacent pairs of parallel wire elements being at predetermined intervals at a sufficient distance apart so as to provide a precise wire strut attachment location for a desired strength and support of the face section; and (b) a plurality of wire struts for interconnecting said face section and floor section and for providing support therebetween, each wire strut comprising an elongated wire rod with curved ends, one curved end attachable to said transverse cross-wire element at said rear edge of said floor section between the parallel wire elements of each parallel wire element pair, and the other curved end attachable to said transverse cross-wire element at said top edge.

9. The wire strut indicator facing unit and strut assembly as claimed in claim 8, wherein said face section is planar with a curved portion adjacent said midpoint and offset from said planar face section.

10. The wire strut indicator facing unit and strut assembly as claimed in claim 8, wherein said face section includes plural transverse cross-wire elements, and wherein said face section plural parallel wire elements and said face section plural transverse cross-wire elements are equidistant from each other.

11. The wire strut indicator facing unit and strut assembly as claimed in claim 8, wherein said floor section is planar from said midpoint bend to said floor section rear edge.

12. The wire strut indicator facing unit and strut assembly as claimed in claim 8, wherein said floor section further includes a first intermediate transverse cross-wire element located approximately halfway between the midpoint bend and floor section rear edge and a second intermediate cross-wire element located adjacent said transverse cross-wire element at said rear edge.

13. The wire strut indicator facing unit and strut assembly as claimed in claim 12, wherein said first and second intermediate and rear edge transverse cross-wire elements are the only transverse cross-wire elements of said floor section.

14. A retaining wall system comprising the wire strut indicator facing unit and strut assembly as claimed in claim 8, further comprising at least one geogrid having a plurality of apertures, said geogrid positionable to overlie at least a portion of said floor section with said wire struts extending through the geogrid apertures.

15. The retaining wall system comprising the wire strut indicator facing unit and strut assembly as claimed in claim 14, wherein said at least one geogrid is one of a uniaxial geogrid and biaxial geogrid.

16. The retaining wall system comprising the wire strut indicator facing unit and strut assembly as claimed in claim 14, wherein said at least one geogrid comprises both a uniaxial geogrid and a biaxial geogrid.

17. A retaining wall system comprising the wire strut indicator facing unit and strut assembly as claimed in claim 8, further comprising a geotextile fabric positionable adjacent said face section.

18. A retaining wall system comprising the wire strut indicator facing unit and strut assembly as claimed in claim 8 and including fill material located in the space defined by said face section and floor section.

* * * * *